US012157159B2

(12) United States Patent
Buttles

(10) Patent No.: US 12,157,159 B2
(45) Date of Patent: Dec. 3, 2024

(54) FORMING SUPERCONDUCTING RADIO FREQUENCY CAVITIES USING HYDROSTATICALLY CONTROLLED BULGING

(71) Applicant: Texas Wind Tower Co., Dallas, TX (US)

(72) Inventor: John Buttles, Los Angeles, CA (US)

(73) Assignee: Texas Wind Tower Co., Dallas, TX (US)

( * ) Notice: Subject to any disclaimer, the term of this patent is extended or adjusted under 35 U.S.C. 154(b) by 0 days.

(21) Appl. No.: 18/421,009

(22) Filed: Jan. 24, 2024

(65) Prior Publication Data

US 2024/0246135 A1 Jul. 25, 2024

Related U.S. Application Data

(60) Provisional application No. 63/481,256, filed on Jan. 24, 2023.

(51) Int. Cl.
*B21D 26/047* (2011.01)

(52) U.S. Cl.
CPC ..... *B21D 26/047* (2013.01)

(58) Field of Classification Search
CPC .. B21D 26/047; B21D 26/033; B21D 26/053; B21D 39/20; B21D 39/206; B21D 39/203
See application file for complete search history.

(56) References Cited

U.S. PATENT DOCUMENTS

| | | | | |
|---|---|---|---|---|
| 3,670,545 | A * | 6/1972 | Kent | B21D 22/105 72/58 |
| 4,418,457 | A * | 12/1983 | Mueller | B21D 39/203 29/523 |
| 5,918,494 | A * | 7/1999 | Kojima | B21D 26/033 72/58 |
| 6,701,764 | B2 * | 3/2004 | Bruck | B21D 26/053 72/58 |
| 2018/0015527 | A1 * | 1/2018 | Maeda | B21D 39/06 |
| 2020/0246860 | A1 * | 8/2020 | Maeda | B21D 39/046 |
| 2022/0347734 | A1 * | 11/2022 | Yamakawa | B62D 29/005 |

* cited by examiner

*Primary Examiner* — Teresa M Ekiert
(74) *Attorney, Agent, or Firm* — Patterson + Sheridan, LLP

(57) ABSTRACT

Forming superconducting radio frequency (SRF) cavities with hydrostatically controlled bulging, using a pressurizing incompressible medium, such as urethane elastomer, for hydroforming a metal tube in a mold. The urethane elastomer functions as the pressurizing incompressible medium in the hydroforming process. Stretch-thinning of the metal tube wall is reduced by a decrease in concentrated bending deformation thereof. Friction between the inner wall of the metal tube and the incompressible medium constrains the plastic flow of the tube wall material, thus reducing the stretch deformation and thickness reduction thereof. A stepped press ram may be used to pressurize the incompressible medium material and then pushes on an end of the tube to feed extra tube length into the expanding tube wall for reducing thinning thereof.

13 Claims, 5 Drawing Sheets

FORMING SUPERCONDUCTING RADIO FREQUENCY CAVITIES USING HYDROSTATICALLY CONTROLLED BULGING

CROSS REFERENCE TO RELATED APPLICATION

This application claims priority to U.S. Provisional Application No. 63/481,256, filed on Jan. 24, 2023, and which is incorporated herein by reference.

TECHNICAL FIELD

Examples of the present disclosure generally relate to superconducting radio frequency (SRF) cavities, and, in particular, to forming SRF cavities using hydrostatically controlled bulging.

BACKGROUND

Superconducting radio frequency (SRF) cavities are used in particle beam accelerators and have become the efficiency standard for large and high-power accelerators worldwide. SRF cavity fabrication out of thick niobium sheets (required for structural strength), joined with e-beam welding comprises the current primary cavity design model. Bulk niobium SRF offered improvements in performance from normal conducting RF accelerators but ongoing developments in superconducting (SC) and SRF physics have revealed capabilities that could deliver higher performance and lower costs if developed and transitioned to production accelerator environments. Particularly, emerging applications in energy production, environmental management, medical services and national security needs would be enabled by higher power accelerators with lower electrical power requirements that can deliver continuous particle beams for solutions in these areas.

Fabrication methods typically used in the production of SRF cavities possess several intrinsic problems due to the use of electron-beam welding. Most problematic of these are weld defects. Even though the electron-beam welding process is highly developed and is performed in a high vacuum environment, welds and zones adjacent to welds generally experience topological surface imperfections such as holes, craters, peaks, pits and grooves. These defects become the source of "quench" effects or thermal breakdown, rapidly dissipating all stored energy in the cavity fields, thereby limiting SRF cavity performance. For example, the first pass yield for a typical 9-cell SRF cavity is in the 60 percent range. Weld defects are cleaned one time, increasing the yield to between 80 and 90 percent. Rejects are simply scrapped out. Welds can also fail subsequently to deployment in the field, requiring further repair or replacement and unacceptably long down time, increasing the effective failure rate even more. Other significant issues are high production cost and significant manufacturing lead time. The reason for high production cost is mainly due to electron beam welding. Electron beam welders are very expensive and must be tightly maintained. The support required by the high voltage and high vacuum technologies can be very demanding. High manufacturing lead time is due to the many steps required for welding and quality control. These include preparing the parts for welding, the actual welding (which must take place in a vacuum), inspection, repair and final inspection. As stated previously, even when a weld appears to be faultless when installed it may still, and often does, fail. It is anticipated that eliminating electron beam welding may reduce the cost per piece by 20 percent and manufacturing lead time by 33 percent.

Hence, there is a need for forming SRF cavities without requiring electron beam welding, e.g., seamless cavity construction.

SUMMARY

Examples of the present disclosure generally relate to methods for forming seamless cavities by using hydrostatically controlled bulging. A metal tube may be placed in a die assembly for forming a portion of the metal tube into a cavity, wherein the die assembly has a chamber defining a volume of the cavity. The metal tube is hydroformed by pressurizing an incompressible medium inside of the metal tube, wherein the pressurized incompressible medium expands the portion of the metal tube into the die assembly chamber defining the volume of the cavity.

Examples of the present disclosure include a method for forming seamless cavities in a metal tube by using hydrostatically controlled bulging. A metal tube is place in a die assembly forming a chamber. An incompressible medium, e.g., urethane cylinder is placed into the metal tube. For example, the urethane cylinder may be pressed into the metal tube with a press ram positioned at an end of the urethane cylinder, wherein the urethane cylinder is pressurized inside of the metal tube and a portion of a wall of the metal tube expands into the die assembly chamber.

Examples of the present disclosure include a superconducting radio frequency (SRF) cavity, comprising a metal tube having a cavity in a portion thereof. The cavity is hydroformed by pressurizing an incompressible medium inside of the metal tube. The pressurized incompressible medium expands the portion of the metal tube into a die assembly chamber defining a volume of the cavity.

BRIEF DESCRIPTION OF THE DRAWINGS

So that the manner in which the above recited features of the present disclosure can be better understood in detail, a more particular description of the disclosure, briefly summarized herein, may be had by reference to examples, some of which are illustrated in the appended drawings. It is to be noted, however, that the appended drawings illustrate only exemplary examples and are therefore not to be considered limiting of its scope, and may admit to other equally effective examples.

To facilitate understanding, identical reference numerals have been used, where possible, to designate identical elements that are common to the figures. It is contemplated that elements and features of one embodiment may be beneficially incorporated in other examples without further recitation.

DETAILED DESCRIPTION

Figure 1A:
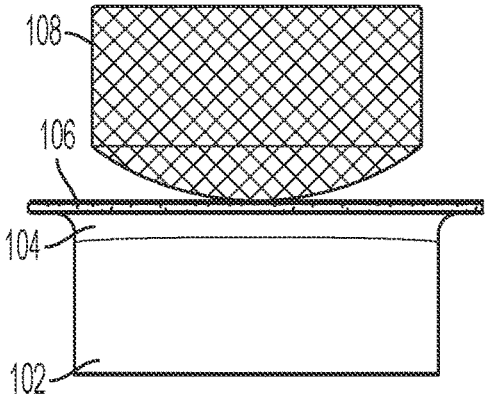
FIGS. 1A-1D illustrate an example and mechanism for minimizing thickness reduction by using a urethane pressurizing medium, according to one or more examples of the disclosure.

Examples of the present disclosure generally relate to forming seamless superconducting radio frequency (SRF) cavities. More specifically, examples provided herein generally include forming SRF cavities with hydrostatically controlled bulging, using a pressurizing incompressible medium, e.g., "hydroforming." An "incompressible medium is defined herein as a material that is deformable but does not change in volume under pressure. A benefit of using a pressurizing incompressible medium instead of hydraulic fluid is that there is no requirement for using expensive sealing mechanisms and hydraulic control systems. Eliminating the sealing and hydraulic control systems facilitates low-cost and high production of the SRF cavities.

Hydroforming may appear to be a relatively simple process because it is mainly comprised of static deformation modes: hydro-expansion and tube feeding. But in actual production, stretch deformation can cause cracking failure at the tube wall, even under an optimal hydroforming condition, for various reasons such as insufficient tube material ductility and/or inferior metallurgical microstructures. Biaxial stretch is inevitable in hydroforming since it is basically an expansion process. If a raw tube material has sufficient ductility, with the aid of feeding extra-tube length the stretch deformation can be balanced with a strain hardening effect during hydroforming. Hydroforming can be successfully completed within the tube material's deformation limit.

If the tube material has insufficient ductility, the degree of stretch deformation can exceed the deformation limit of the tube material even under an optimal hydroforming condition. The tube being formed is susceptible to cracking failure. Cracking occurrence could increase greatly if the tube has non-uniform microstructure or geometrical imperfection. Hydroforming pressure creates stress singularity effects at locally weak areas. The area is subjected to concentrated stretch deformation along with localized thickness reduction to lose geometrical stiffness, with the consequence of premature cracking in the early hydroforming stage.

Efforts have been made to improve the work piece tube quality by use of materials such as, but not limited to, niobium. Niobium (Nb) is the SC (superconductor) of choice in "bulk niobium" SRF cavities. However, a new/emerging SC for cavities is $Nb_3Sn$ (niobium$_3$tin), an (intermetallic) high-temperature SC that has a higher Tc of 18 degrees Kelvin over pure Nb of 9.2 degrees Kelvin. $Nb_3Sn$ cavities can run on gaseous helium at 4K rather than liquid helium at 2K—HUGE difference on operating cost which is a big breakthrough. NbsSn high-temperature SC is still in development stages but it will displace bulk Nb at some point. $Nb_3Sn$ is created by furnace reaction, electroplating, gaseous diffusion—still under development and industrialization, and will require a copper substrate cavity. But copper as a SC substrate, for example but not limited to, CDA 101 or C101 pure copper, has possibilities because no welding is required according to the teachings of this disclosure. This is of particular importance to new high-temperature SC cavity operation. Copper also has high thermal conductivity.

It is contemplated and within the scope of this disclosure that any ductile metal materials that can be used for radio frequency superconducting applications may be processed and formed according to the teachings of this disclosure. In addition to the aforementioned Nb, $Nb_3Sn$ and copper materials, aluminum may be used and the like. Preferably SC materials used will include ductility improvement, grain size refinement and tube production development improvements. However, in future mass production manufacturing of seamless cavities made from such materials, it may be a reasonably conservative assumption that the raw tube materials will have quality deviations, e.g., different ductility limits between the raw material tubes to be formed.

It is contemplated and within the scope of this disclosure that a reduction of stretch deformation in a tube undergoing hydroforming would be benefitted by the use of a pressurizing incompressible medium in solid or fluid form such as, for example but not limited to, elastomer, e.g., urethane; ooblek fluids (mixture of cornstarch and water), non-Newtonian fluids, shear thickening (dilatant) material in suspension, and the like. The hydroforming technique disclosed herein can be generally applied to other cavity designs having different shapes, for example but not limited to, elliptical, non-elliptical, symmetrical and nonsymmetrical geometries and cell numbers, e.g., forming multi-chambered and crab cavities of any shapes and sizes using appropriately shaped dies and reentrant hydroforming by pressurizing with an incompressible medium as mentioned hereinabove.

Figure 1B:
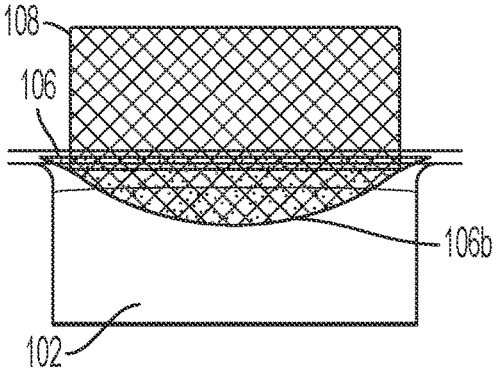

Stretch deformation and thickness reduction are primary concerns since they are major causes of cracking failure in formed parts. In the case of a deep drawn part where thickness control is challenging, a preferred practice, according to the teachings of this disclosure, is to incorporate a pressurizing incompressible medium such as, for example but is not limited to, an elastomer in the forming procedure (usually urethane). The use of urethane significantly decreases the thickness reduction in the formed part by a urethane friction mechanism, so called 'Urethane Grabbing' in actual practice. Referring to FIGS. 1A-1D, depicted is an example and mechanism for minimizing thickness reduction by using a urethane pressurizing medium. FIGS. 1A and 1B show a dome-forming example with a urethane insert 102. Note that the dome center region is most subjected to cracking failure in general because of the highest degree of bending and stretch deformation. FIG. 1A is the initial set-up. A urethane insert 102 is deposed in a die cavity 104, then a raw blank 106 is placed between a punch 108 and the die cavity 104 for draw forming. "Punch" and "press ram" will be used interchangeably hereinafter. FIG. 1B shows the forming progress. As the punch 108 presses down on the blank 106 being formed, the blank center 106*a* is bent and then comes into contact with the urethane insert 102. The urethane insert 102 wraps the dome center area 106*b* of the blank 106 since it behaves like an incompressible fluid (incompressible elastomer). The dome center area 106*b*, wrapped by the urethane insert 102, is prevented from cracking failure by reducing stretch deformation with the urethane grabbing feature of the urethane insert 102.

Figure 1C:
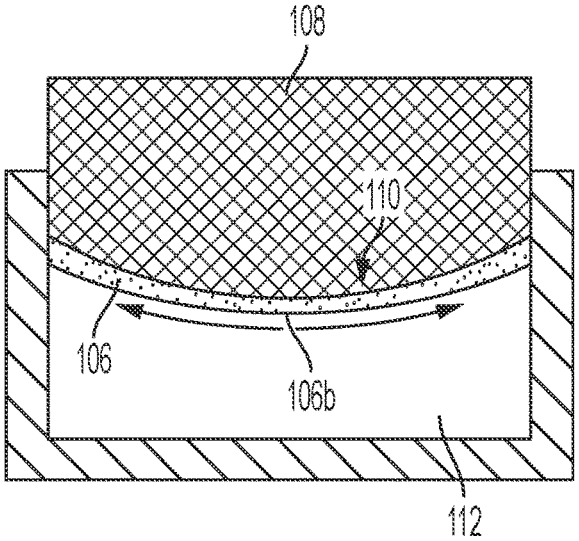
Figure 1D:
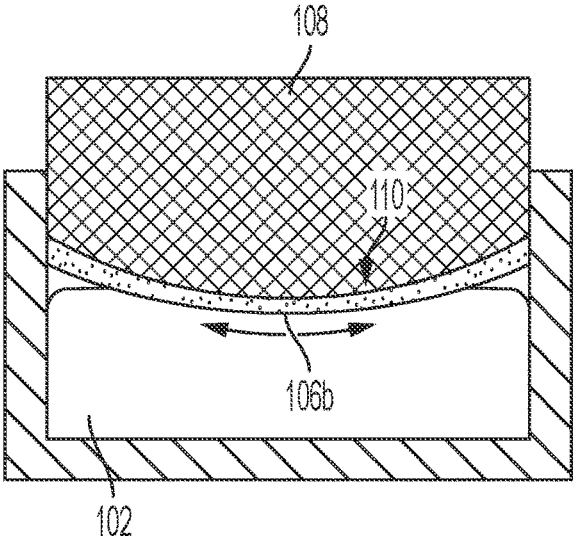

Referring to FIGS. 1C and 1D, depicted is a mechanism that provides for decreased stretch deformation by using urethane. FIG. 1C shows the drawing process in which a dome 110 is formed in a hollow die cavity 112 without urethane. As the raw blank 106 material is pressed down by the punch 108, the dome center area 106*b* is bent and creates significant material plastic flow to outward directions (curved arrows). The stretch deformation by the material flow results in metallurgical damage and thickness reduction. Cracking failure occurs when they become excessive. FIG. 1D shows when that dome drawing operation is performed with the urethane insert 102. As the dome 110 of the blank 106 is pressed down, the dome center area 106*b* comes into contact with and compresses the urethane insert 102. Since urethane behaves like an incompressible fluid, it wraps the dome center area 106*b*. In addition, since urethane is a solid material, it creates coulombic friction when contacting the surface of the dome center area 106*b*. It constrains material plastic flow of the blank 106 at dome center area 106*b*. Instead, stretch deformation occurs uniformly along the overall dome 110 profile. Localized stretch deformation is reduced at the dome center area 106*b* where the cracking potential is highest, leading to a successful deep drawing process.

As disclosed herein, urethane behaves like an incompressible fluid, while it creates coulombic friction to constrain stretch deformation in a part being formed. Given the characteristic behavior and mechanical benefits, use of urethane as a pressurizing medium in hydroforming creates multiple advantages. Specifically, since the friction mechanism creates substantially uniform stretch deformation along the forming part, it will greatly reduce the localized stretch deformation at an equator diameter (expanded area of tube, see FIG. 2B), thus securing reliable and repeatable hydroforming of seamless SRF cavities.

Figure 2A:
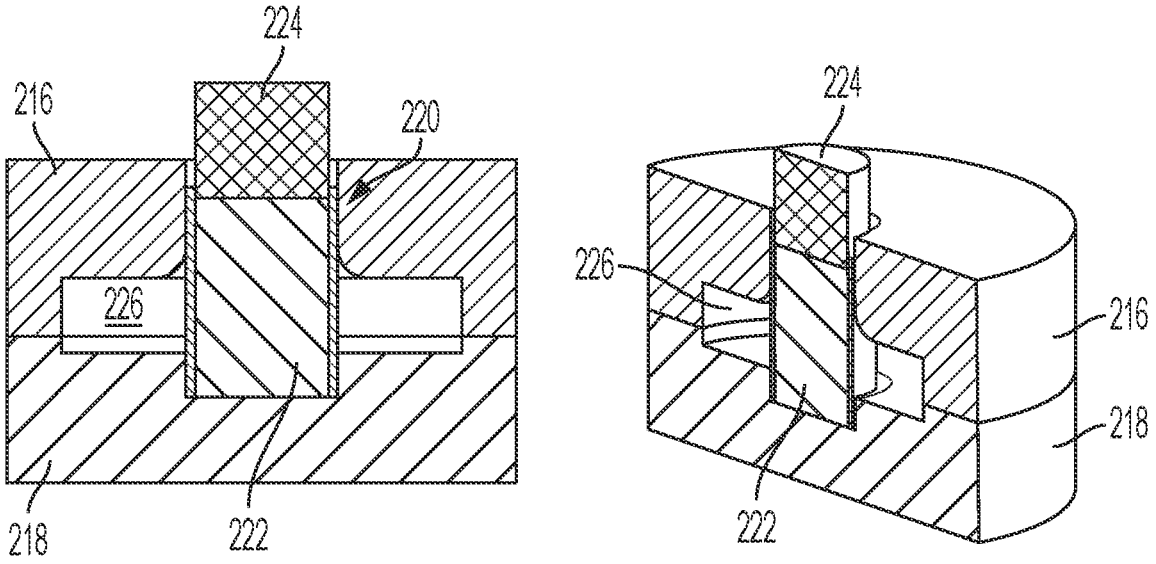
FIGS. 2A and 2B illustrate schematic diagrams of urethane hydroforming, according to one or more examples of the disclosure.
Figure 2B:
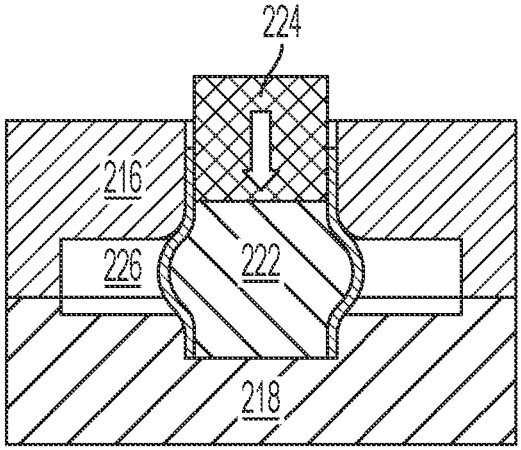

Referring to FIGS. 2A and 2B, depicted are schematic diagrams of urethane hydroforming, according to one or more examples of the disclosure. Urethane functions as an incompressible elastomer material in the hydroforming process disclosed and claimed herein. FIG. 2A shows an initial urethane hydroforming set-up. An upper die 216 and a lower die 218 are aligned to receive a metal tube 220, e.g., a tube made of copper or Niobium material. After the tube 220 is positioned in the upper die 216 and lower die 218, a urethane cylinder 222 is inserted into the tube 220. A press ram 224 is positioned at an end (shown at top) of the urethane cylinder 222, and is adapted to squeeze and pressurize the urethane cylinder 222 inside of the tube 220. Note that in order for expansion of the tube 220, a cavity space 226 is assigned between the upper die 216 and lower die 218. FIG. 2B shows the hydroforming process using compression of the urethane cylinder 220. As the urethane cylinder 220 is pushed down and compressed by the press ram 224, it expands the tube 220 into the cavity space 226. Since the urethane cylinder 222 creates coulombic friction with the inside surface of the tube 220, plastic material flow of the wall of tube 220 becomes substantially uniform, thus reducing localized stretch deformation (see FIG. 1D).

Figure 3:
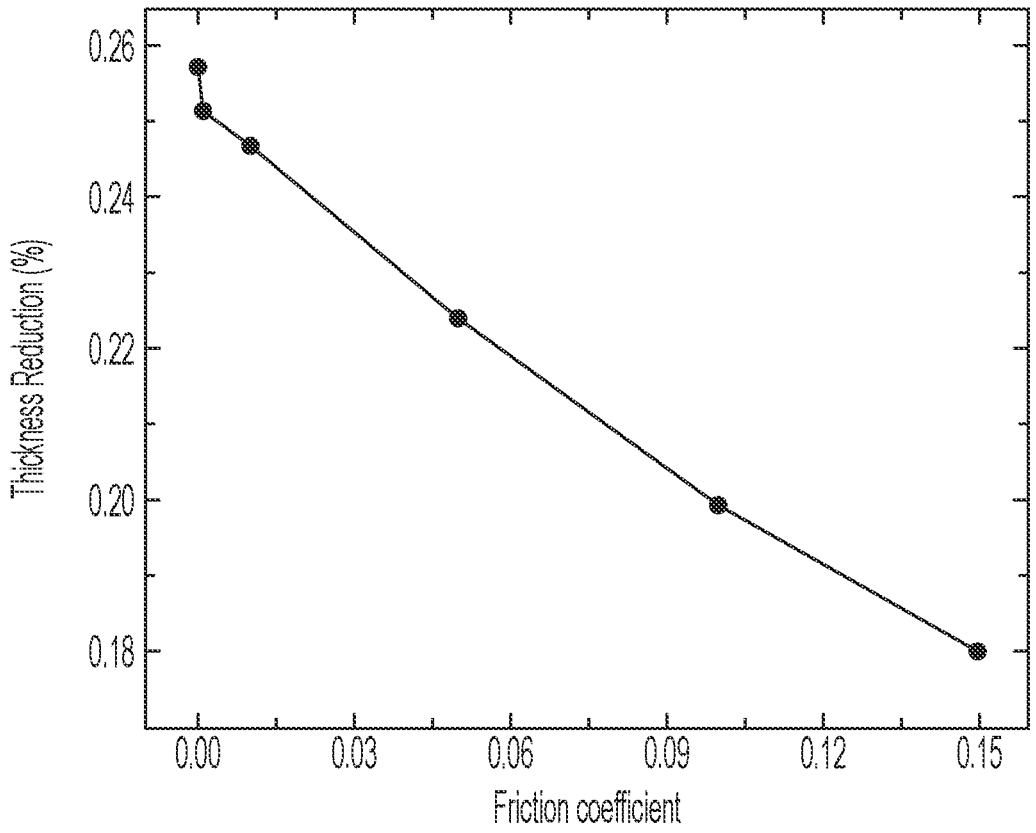
FIG. 3 illustrates a graph showing stretch deformation at the wall of a tube with variations in the friction coefficient between a urethane cylinder and expanding tube wall, according to one or more examples of the disclosure.

Using urethane hydroforming, thickness reduction occurs all along the tube height, e.g., more uniformly, with the consequence of decreased maximum thickness reduction of the tube 220 wall. This may be provided first by the urethane stiffness, where the tube is expanded with a more flattened profile. Stretch-thinning is reduced by a decrease in concentrated bending deformation. Second, the friction between the inner wall of the tube 220 and the urethane cylinder 222 constrains the plastic flow of the tube wall material, thus reducing the stretch deformation and thickness reduction thereof. FIG. 3 depicts a graph showing stretch deformation at the wall of tube 220 with variations in the friction coefficient between the urethane cylinder 222 and expanding tube wall. The wall thickness reduction (thinning) becomes less when the frictional force increases between the urethane surface and inner wall of the tube 220, confirming a beneficial role of friction in urethane hydroforming. The friction coefficient may be changed by 1) varying the urethane material type, and 2) controlling the urethane surface condition. The friction coefficient of a urethane material is strongly dependent on hardness, and the urethane surface condition may be modified, for example but not limited to, blasting treatment to control and vary the surface friction coefficient thereof.

Figure 4:
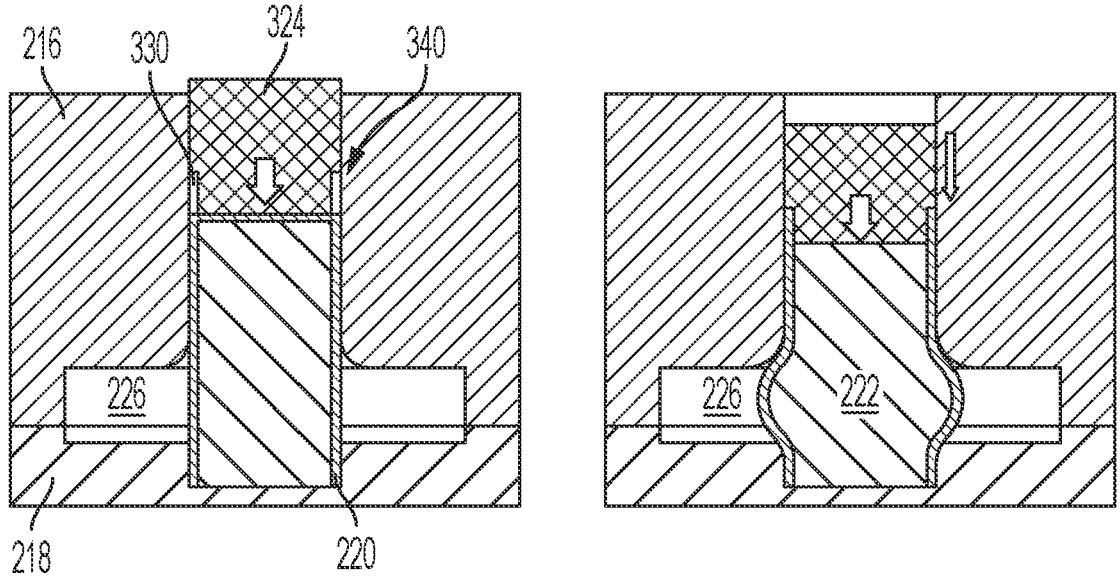
FIG. 4 illustrates schematic diagrams of urethane hydroforming of a metal tube additionally using a tube feeding mechanism, according to one or more examples of the disclosure.

Increasing the initial length of the tube 220 to be urethane hydro-formed may further improve wall thickness reduction. Referring to FIG. 4, depicted are schematic diagrams of urethane hydroforming of a metal tube additionally using a tube feeding mechanism, according to one or more examples of the disclosure. A stepped punch 324, having a shoulder 330, may be used to first compress the urethane cylinder 222 (increase inside pressure to the tube 220) as shown in FIG. 4. The stepped punch 324 has a gap 340 between the edge of tube 220 and the shoulder 330 of the stepped punch 324, allowing it to enter and further compress the urethane cylinder 222 before contacting the end of the tube 220. As the punch 324 travels down to pressurize the urethane cylinder 222, the gap 340 is closed, and when the gap 340 closes the shoulder 330 of the stepped punch 324 engages the end of the tube 220. The downward force from the shoulder 330 to the tube edge (at the end of the tube 220) creates a mechanism equivalent to feeding extra tube length into the expanding tube wall to reduce thinning thereof. The height of the gap 340 (travel distance) may be adjusted for best urethane hydroforming results, e.g., minimize wall thickness reduction.

As disclosed previously herein for the urethane frictional mechanism (Urethane Grabbing), other incompressible mediums may have frictional mechanisms that can be used to create uniform stretch deformation along the forming part, and can reduce the localized stretch deformation at an equator diameter (expanded area of tube, see FIG. 2B). The surface frictional effect of the incompressible medium has the ability to move the material of the part (work piece) into its final shape. Fluids (e.g., liquids) having a morphology of larger particles suspended in the liquid may improve the grabbing of the inside surface of the work piece, and fluids having smaller particles suspended in the liquid may benefit by "surface effect" grabbing.

Figure 5A:
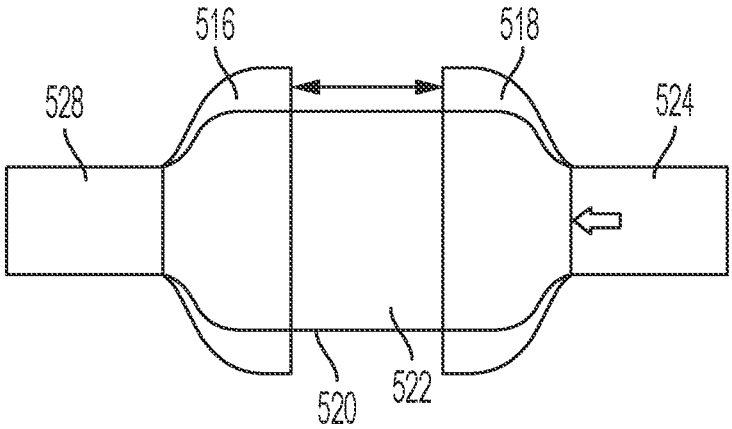
FIGS. 5A, 5B and 5C illustrate schematic diagrams of urethane hydroforming and a moveable press mold, according to one or more examples of the disclosure.
Figure 5B:
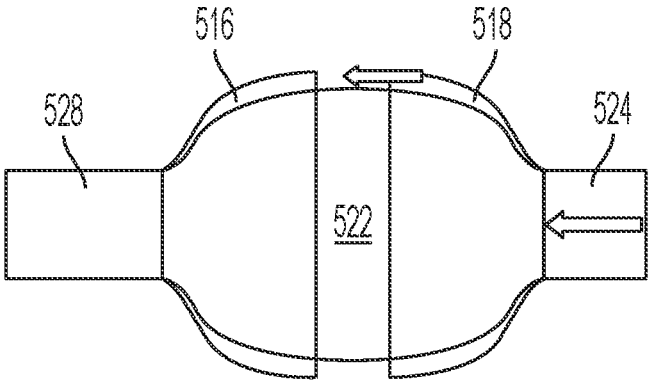
Figure 5C:
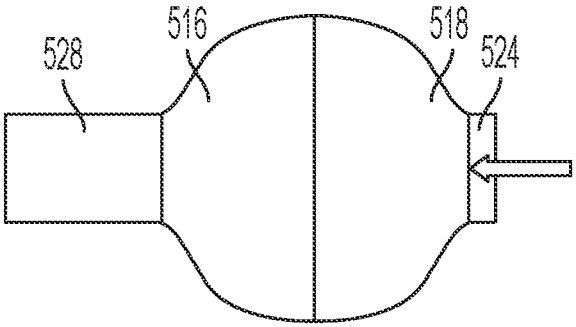

Referring to FIGS. 5A, 5B and 5C, depicted are schematic diagrams of urethane hydroforming and a moveable press mold, according to one or more examples of the disclosure. First and second mold halves 516 and 518 may be set apart a gap width and metal tube 520 may be inserted between the first and second mold halves 516 and 518. The metal tube 520 may be "expanded out" toward the inner surfaces of the mold halves 516 and 518 by the urethane cylinder 522 that is inserted into the tube 520. The urethane cylinder 522 is pressurized by movement of the punch 524 into an end of the urethane cylinder 522. While the tube 520 is expanding into the mold halves 516 and 518, the gap may be reduced as the mold halves 516 and 518 are brought together as shown in FIG. 5B. When the mold halves 516 and 518 have full closed, as shown in FIG. 5C, the tube 520 will fully expand to the desired equator diameter (inside shape of mold halves 516 and 518) from the continuing pressure of the urethane cylinder 522.

Figure 6A:
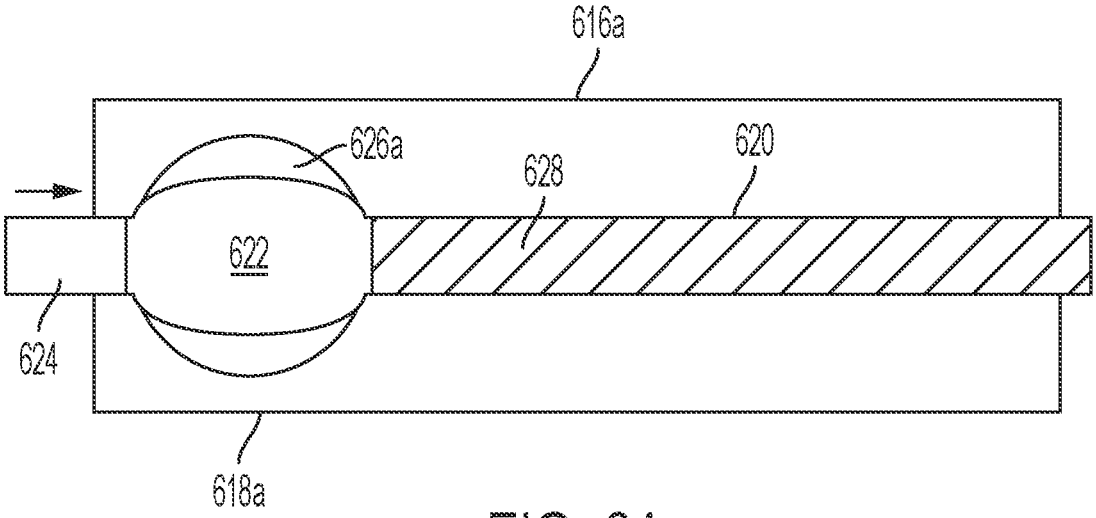
FIGS. 6A, 6B and 6C illustrate schematic diagrams of urethane hydroforming in a multi-cavity press mold, according to one or more examples of the disclosure.
Figure 6B:
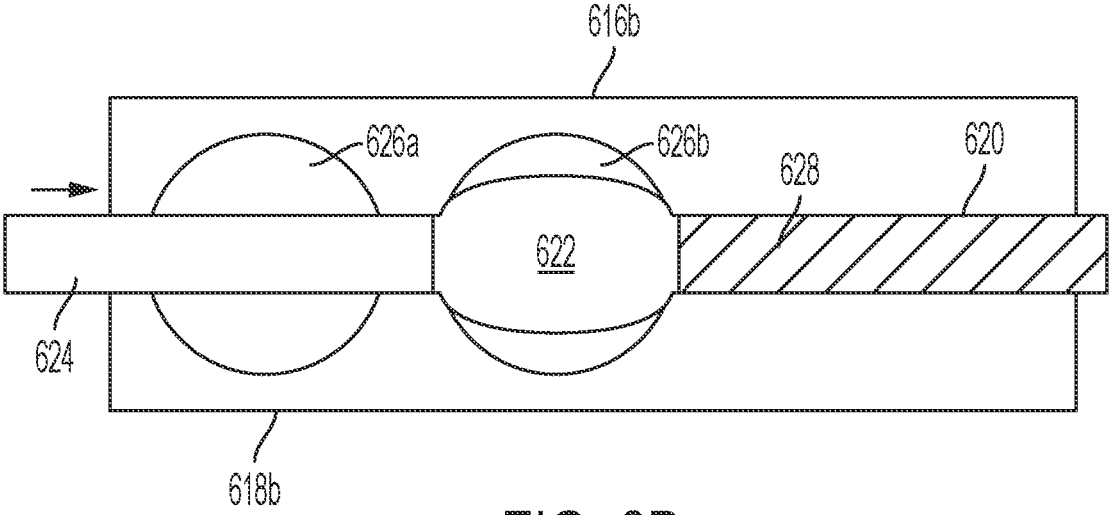
Figure 6C:
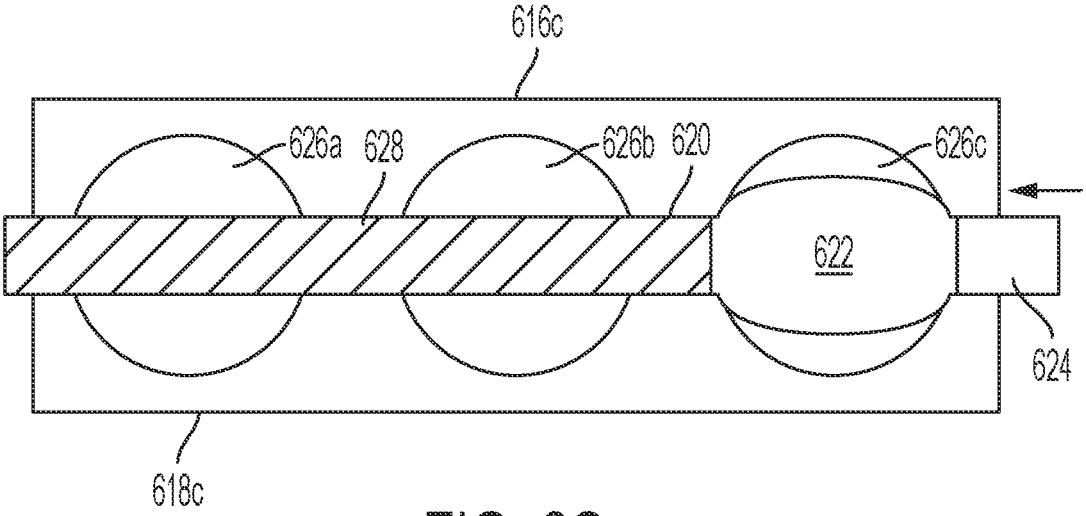

Referring to FIGS. 6A, 6B and 6C, depicted are schematic diagrams of urethane hydroforming in a multi-cavity press mold, according to one or more examples of the disclosure.

FIG. 6A shows a first cavity 626*a* being formed in first and second mold halves 616*a* and 618*a* when the incompressible medium 622 is pressurized in the tube 620 by travel of the punch 624. The stop 628 keeps the incompressible medium 622 in a first portion of the tube 620 inside of the first and second mold halves 616*a* and 618*a*. From the pressure of the incompressible medium 622, the wall of the tube 620 will expand into the space allocated for the cavity 626*a* in the first and second mold halves 616*a* and 618*a* to form a first cavity 626*a*.

After the first cavity 626*a* has been formed as described above, the stop 628 is moved to the right such that a second portion of the tube 620 is inside of the first and second mold halves 616*b* and 618*b*. More incompressible medium 622 is introduced into the tube 620 and pressurized by travel of the punch 624. The stop 628 keeps the incompressible medium 622 in a portion of the tube 620 inside of the first and second mold halves 616*b* and 618*b*. From the pressure of the incompressible medium 622, the wall of the tube 620 will expand into the space allocated for the cavity 626*b* in the first and second mold halves 616*b* and 618*b* to form a second cavity 626*b*.

After the second cavity 626*b* has been formed as described above, the stop 628 is reversed to the left such that a third portion of the tube 620 is inside of the first and second mold halves 616*c* and 618*c*. More incompressible medium 622 is introduced into the tube 620 and pressurized by travel of the punch 624. The stop 628 keeps the incompressible medium 622 in a portion of the tube 620 inside of the first and second mold halves 616*c* and 618*c*. From the pressure of the incompressible medium 622, the wall of the tube 620 will expand into the space allocated for the cavity 626*c* in the first and second mold halves 616*c* and 618*c*.

FIGS. 6A, 6B and 6C show a three step process for forming a three cavity device. However, a single step may be performed instead by putting a tube 620 into a three chamber mold (not shown but just the combination of molds 616*a-c* and 618*a-c*). The incompressible medium 622 is introduced between the left side of chamber 626*a* and the right side of chamber 626*c*, then pressurized with the punch 624 until the walls of the tube 620 have expanded to fill all three chamber openings of the first and second molds 616 and 618. This method is also applicable to forming odd shaped cavities such crab cavities.

Removal of the pressurizing incompressible medium used in hydroforming may be done in different ways depending upon the material used. For example, urethane will generally snap back to its original shape and may be removed in the same way it was introduced into the work piece. Fluids such as Ooblek, non-Newtonian fluids, shear thickening material in suspension, and the like; would be self-evacuating because they can run or be rinsed out of the work piece.

Urethane has been discussed hereinabove as being representative one of many possible pressurizing incompressible mediums, and use of other pressurizing incompressible mediums are contemplated herein and can be utilized effectively by one having ordinary skill in the art of hydroforming and with the teachings of this disclosure.

The present disclosure has been described in terms of one or more examples, and it should be appreciated that many equivalents, alternatives, variations, and modifications, aside from those expressly stated, are possible and within the scope of the disclosure.

What is claimed is:

1. A method for forming a seamless cavity, comprising:

providing a die assembly having a cavity defined by a first die in contact with a second die, the die assembly having a single opening, the single opening disposed through the first die to receive a metal tube;

placing the metal tube through the single opening of the die assembly such that a portion of the metal tube is in a volume of the cavity, the cavity including a space surrounding the metal tube;

disposing an incompressible medium inside of the metal tube through the single opening of the first die; and moving a single punch or ram only through the single opening of the first die into an end of the incompressible medium inside of the metal tube, the moving the single punch or ram comprises:

pressurizing only the incompressible medium for a first distance of travel of the single punch or ram into the metal tube; and contacting the end of the metal tube with only the single punch or ram and pushing axially a second distance into the metal tube further increasing pressure of the incompressible medium inside of the metal tube, wherein the incompressible medium pressurized by the moving the single punch or ram expands the portion of the metal tube into the cavity of the die assembly to form the seamless cavity of the metal tube in the space surrounding the cavity.

2. The method of claim 1, wherein the die assembly has a plurality of cavities.

3. The method of claim 1, wherein the incompressible medium is an elastomer.

4. The method of claim 3, wherein the elastomer is urethane.

5. The method of claim 1, wherein the incompressible medium is an ooblek fluid.

6. The method of claim 1, wherein the incompressible medium is a non-Newtonian fluid.

7. The method of claim 1, wherein the incompressible medium is a shear thickening (dilatant) material in suspension.

8. The method of claim 1, wherein the metal tube is made of niobium.

9. The method of claim 1, wherein the metal tube is made of copper.

10. The method of claim 9, wherein the metal tube made of copper is plated with $Nb_3Sn$ (niobium$_3$tin).

11. A method, comprising:

providing a die assembly having a cavity defined by a first die in contact with a second die, the first die having an opening to receive a metal tube;

placing the metal tube through the opening of the die assembly such that a portion of the metal tube is in a volume of the cavity;

disposing an incompressible medium inside of the metal tube through the opening of the first die;

providing a stepped press ram having a shoulder, wherein there is a gap between an end of the metal tube and the shoulder of the stepped press ram;

pressurizing only the incompressible medium for a first distance of travel of the stepped press ram into the metal tube; and contacting the end of the metal tube with the shoulder of the stepped press ram when the gap closes, then pushing axially a second distance of travel of the stepped press ram into the metal tube, thereby forcing metal tube material into the expanding area of the tube wall, and further increasing pressure of the incompressible medium inside of the metal tube.

12. A method for forming a seamless cavity, comprising:

providing a die assembly having a cavity defined by a first die in contact with a second die, the die assembly having a single opening, the single opening disposed through the first die to receive a metal tube;

placing the metal tube through the single opening of the die assembly such that a portion of the metal tube is in a volume of the cavity, the cavity including a space surrounding the metal tube;

placing a urethane cylinder into the metal tube through the single opening of the first die; and pressing the urethane cylinder in the metal tube with a single punch or ram positioned at an end of the urethane cylinder, the moving the single punch or ram comprises:

pressurizing only the urethane cylinder for a first distance of travel of the single punch or ram into the metal tube; and contacting the end of the metal tube with the single punch or ram and pushing axially a second distance into the metal tube further increasing pressure of the urethane cylinder inside of the metal tube, wherein the urethane cylinder is pressurized inside of the metal tube and a portion of a wall of the metal tube expands into the cavity of the die assembly chamber to form a seamless cavity of the metal tube in the space surrounding the cavity.

13. A method, comprising:

providing a die assembly having a cavity defined by a first die in contact with a second die, the first die having an opening to receive a metal tube;

placing the metal tube through the opening of the die assembly such that a portion of the metal tube is in a volume of the cavity;

placing a urethane cylinder into the metal tube through the opening of the first die;

providing a stepped press ram having shoulder, wherein there is a gap between an end of the metal tube and the shoulder of the stepped press ram;

pressurizing only the urethane cylinder for a first distance of travel of the stepped press ram into the metal tube; and contacting the end of the metal tube with the shoulder of the stepped press ram when the gap closes, then pushing axially a second distance of travel of the stepped press ram into the metal tube, thereby forcing metal tube material into the expanding area of the tube wall, and further increasing pressure of the urethane cylinder inside of the metal tube.

* * * * *